US011871841B2

(12) United States Patent
Yang et al.

(10) Patent No.: US 11,871,841 B2
(45) Date of Patent: Jan. 16, 2024

(54) COMPUTER DESK

(71) Applicant: HUIZHOU CHINA STAR OPTOELECTRONICS DISPLAY CO., LTD., Guangdong (CN)

(72) Inventors: Baolei Yang, Guangdong (CN); Weiwei Zheng, Guangdong (CN)

(73) Assignee: HUIZHOU CHINA STAR OPTOELECTRONICS DISPLAY CO., LTD., Guangdong (CN)

( * ) Notice: Subject to any disclaimer, the term of this patent is extended or adjusted under 35 U.S.C. 154(b) by 190 days.

(21) Appl. No.: 17/600,303

(22) PCT Filed: Jul. 13, 2021

(86) PCT No.: PCT/CN2021/105977
§ 371 (c)(1),
(2) Date: Sep. 30, 2021

(87) PCT Pub. No.: WO2022/262040
PCT Pub. Date: Dec. 22, 2022

(65) Prior Publication Data

US 2022/0400847 A1 Dec. 22, 2022

(30) Foreign Application Priority Data

Jun. 16, 2021 (CN) ..... 202110665686.6

(51) Int. Cl.
*A47B 21/007* (2006.01)
*A47B 21/04* (2006.01)

(52) U.S. Cl.
CPC ..... *A47B 21/0073* (2013.01); *A47B 21/04* (2013.01); *A47B 2200/0073* (2013.01)

(58) Field of Classification Search
CPC ..... A47B 21/0073; A47B 21/04; A47B 2200/0073

(Continued)

(56) References Cited

U.S. PATENT DOCUMENTS 6,553,919 B1 * 4/2003 Nevin ..... A47B 21/0073 108/50.01
6,827,409 B2 * 12/2004 Michael ..... A47B 21/0073 248/920

(Continued)

FOREIGN PATENT DOCUMENTS

CH 203454 A 3/1939
CN 2843185 Y 12/2006

(Continued)

*Primary Examiner* — Daniel J Troy
*Assistant Examiner* — Timothy M Ayres
(74) *Attorney, Agent, or Firm* — Mark M. Friedman

(57) ABSTRACT

The present invention provides a computer desk, including a desktop and a desktop supplementary board connected to the desktop using a turning device. The desktop is provided with an accommodating gap, and a display is mounted on the turning device. The desktop supplementary board, relative to the desktop, has a first position and a second position. When at the first position, the desktop supplementary board is in the accommodating gap, and the display stands upright on the desktop. When at the second position, the display is in the accommodating gap for ease of flat use, and the desktop supplementary board is located below the desktop.

18 Claims, 6 Drawing Sheets

(58) Field of Classification Search
USPC ..... 312/223.3
See application file for complete search history.

(56) References Cited

U.S. PATENT DOCUMENTS

| | | | | |
|---|---|---|---|---|
| 7,100,516 | B2 * | 9/2006 | Riddiford | A47B 21/0073 108/50.01 |
| 8,826,830 | B2 * | 9/2014 | Pajic | B60N 3/004 108/50.01 |
| 2004/0123782 | A1 | 7/2004 | Korber | |
| 2005/0145142 | A1 | 7/2005 | Korber | |
| 2007/0057140 | A1 | 3/2007 | Liou | |
| 2008/0250985 | A1 | 10/2008 | Hall | |
| 2008/0265121 | A1 | 10/2008 | Drew | |
| 2010/0307382 | A1 * | 12/2010 | Mammana | A47B 21/007 108/1 |
| 2012/0153788 | A1 | 6/2012 | Rozestraten | |
| 2012/0260830 | A1 * | 10/2012 | Luiten | A47B 21/0073 108/50.11 |
| 2013/0068141 | A1 * | 3/2013 | Hsiao | A47B 21/0073 108/2 |
| 2013/0068916 | A1 | 3/2013 | Mensing | |
| 2016/0070964 | A1 | 3/2016 | Conrad | |

FOREIGN PATENT DOCUMENTS

| | | | |
|---|---|---|---|
| CN | 104932610 | A | 9/2015 |
| CN | 204734107 | U | 11/2015 |
| CN | 106859031 | A | 6/2017 |
| CN | 108835883 | A | 11/2018 |
| CN | 208243178 | U | 12/2018 |
| CN | 208957137 | U | 6/2019 |
| CN | 110236293 | A | 9/2019 |
| CN | 209528398 | U | 10/2019 |
| CN | 209644256 | U | 11/2019 |
| CN | 209931859 | U | 1/2020 |
| CN | 210440870 | U | 5/2020 |
| CN | 210581577 | U | 5/2020 |
| CN | 211354374 | U | 8/2020 |
| CN | 212298464 | | 1/2021 |
| CN | 212489027 | U | 2/2021 |
| CN | 213281995 | U | 5/2021 |
| JP | 2001000252 | A | 1/2001 |

* cited by examiner

COMPUTER DESK

FIELD OF INVENTION

The present invention relates to the field of display technologies, and in particular, to a computer desk.

BACKGROUND OF INVENTION

Due to the maturity of touch technology solutions and the adaptation of software, touch operations or creations of a computer can be gradually implemented directly on a screen, for example, art works can be directly created on a display, and writing, drawing, exercises, studying, and the like may be implemented on the display.

However, people are accustomed to drawing and writing on a flat desktop, so that a conventional display cannot be laid flat to bring people a comfortable drawing and writing feeling.

SUMMARY OF INVENTION

Technical Problem

An objective of the present invention is to provide a computer desk, which is intended to enable, by using a turning device, a display not only to be displayed upright, but also to be laid flat in a desktop to facilitate a touch operation of a user.

Technical Solution

The present invention provides a computer desk, including:

a desktop, wherein the desktop is provided with an accommodating gap;

a desktop supplementary board, wherein the desktop supplementary board is connected to the desktop using a turning device, and a display is mounted on the turning device; and the desktop supplementary board has, relative to the desktop, a first position and a second position, when the desktop supplementary board is at the first position, the desktop supplementary board is in the accommodating gap, and the display stands upright on the desktop, and when the desktop supplementary board is at the second position, the desktop supplementary board is located below the desktop, and the display is in the accommodating gap.

Further preferably, the turning device includes:

- a first rotary shaft, wherein the first rotary shaft is mounted on a back surface of the desktop;
- a second rotary shaft parallel to the first rotary shaft, wherein the second rotary shaft is provided with the display;
- a third rotary shaft parallel to the first rotary shaft, wherein the third rotary shaft is connected to the desktop supplementary board;
- a first connecting rod separately connected to one end of the first rotary shaft, the second rotary shaft, and the third rotary shaft; and
- a second connecting rod separately connected to an other end of the first rotary shaft, the second rotary shaft, and the third rotary shaft.

Further preferably, the back surface of the desktop is provided with a first rotating ring and a second rotating ring, the end of the first rotary shaft is connected to the first rotating ring, and the other end of the first rotary shaft is connected to the second rotating ring.

Further preferably, when the first rotary shaft rotates in the first rotating ring and the second rotating ring, the turning device rotates relative to the desktop.

Further preferably, the first connecting rod and the second connecting rod are two L-shaped connecting rods parallel to each other, each L-shaped connecting rod includes a first support rod and a second support rod that are perpendicular to each other, two ends of the first rotary shaft are respectively connected to corners of the two L-shaped connecting rods, two ends of the second rotary shaft are respectively connected to end portions of the two first support rods, and two ends of the third rotary shaft are respectively connected to end portions of the two second support rods.

Further preferably, the desktop is further provided with a first opening slot and a second opening slot that communicate with the accommodating gap, the first opening slot and the second opening slot are respectively located at the two ends of the first rotary shaft; and when the desktop supplementary board is at the first position, the first opening slot and the second opening slot accommodate part of the first support rod.

Further preferably, a third rotating ring and a fourth rotating ring are respectively sleeved at the two ends of the second rotary shaft of the turning device, and the third rotating ring and the fourth rotating ring are respectively connected to the display.

Further preferably, when the second rotary shaft rotates in the third rotating ring and the fourth rotating ring, the display rotates relative to the second rotary shaft.

Further preferably, the desktop supplementary board has a first side connected to the third rotary shaft and a second side opposite to the first side, the first side of the desktop supplementary board has a rotating groove, and the third rotary shaft is located in the rotating groove.

Further preferably, two sides of the second side of the desktop supplementary board have two rolling wheels, two sliding rails are further mounted on the back surface of the desktop, and the two rolling wheels are respectively located in the two sliding rails.

Further preferably, the sliding rail has a first end located at a corner of the accommodating gap and a second end located obliquely below the first end, when the desktop supplementary board is at the first position, the rolling wheel is located at the first end of the sliding rail, and when the desktop supplementary board is at the second position, the rolling wheel is located at the second end of the sliding rail.

Further preferably, the sliding rail has a third end near the first end, and the third end is higher than the first end.

Further preferably, when the desktop supplementary board is in the accommodating gap, and the display stands upright on the desktop, a distance between the display and a user is greater than a width of the desktop supplementary board.

Further preferably, when the desktop supplementary board is at the first position, the first rotary shaft, the third rotary shaft, and the second support rod are located on the back surface of the desktop, and when the desktop supplementary board is at the second position, the turning device is located on the back surface of the desktop.

Further preferably, a width of the display is equal to a distance between the two L-shaped connecting rods.

Further preferably, the back surface of the desktop is further provided with two support blocks, and each support block is located at an edge of the accommodating gap and partially extends into the accommodating gap.

Further preferably, when the display is in the accommodating gap, the support block, the first support rod, and the second rotary shaft are in contact with a back surface of the display.

Further preferably, the back surface of the desktop has a groove accommodating the first end of the sliding rail.

Further preferably, the computer desk further includes a retaining wall located outside each of the sliding rails, wherein the retaining wall is connected to the back surface of the desktop.

Further preferably, the computer desk further includes a desk body, wherein the desk body is located below the desktop.

Beneficial Effects

The present invention provides a computer desk, including a desktop and a desktop supplementary board connected to the desktop using a turning device. The desktop is provided with an accommodating gap, and a display is mounted on the turning device. The desktop supplementary board, relative to the desktop, has a first position and a second position. When at the first position, the desktop supplementary board is in the accommodating gap, and the display stands upright on the desktop. When at the second position, the display is in the accommodating gap for ease of flat use, and the desktop supplementary board is located below the desktop. Therefore, upright display and flat use of the display can be implemented by moving the desktop supplementary board between the first position and the second position. In addition, when the display is displayed upright, the desktop supplementary board is in the accommodating gap. Therefore, there are no holes on the desktop, which is convenient for office use.

BRIEF DESCRIPTION OF DRAWINGS

The following describes specific implementations of the present invention in detail with reference to the accompanying drawings, to make the technical solutions and other beneficial effects of the present invention obvious.

DETAILED DESCRIPTION OF PREFERRED EMBODIMENTS

Figure 1:
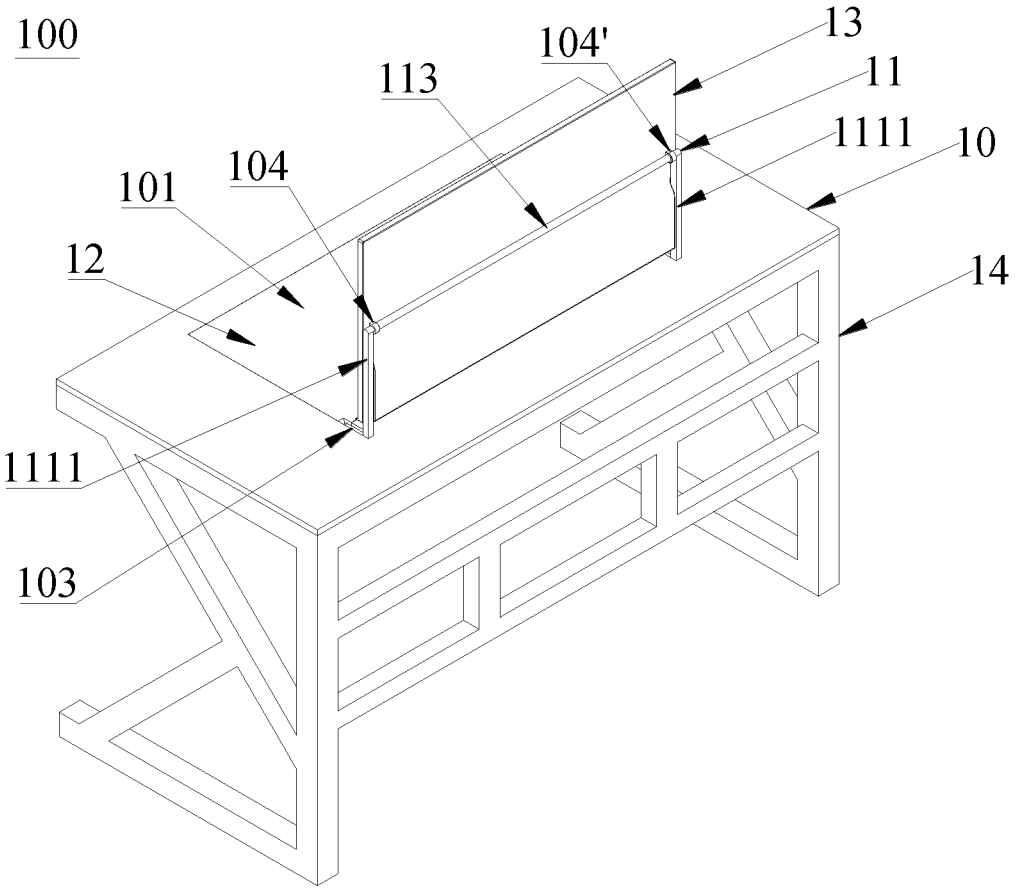
FIG. 1 is a schematic diagram of a structure of a computer desk when a desktop supplementary board is at a first position according to an embodiment of the present invention.

The technical solutions of the embodiments of the present invention are clearly and completely described in the following with reference to the accompanying drawings of the embodiments of the present invention. Apparently, the described embodiments are merely some but not all of the embodiments of the present invention. All other embodiments obtained by a person of ordinary skill in the art based on the embodiments of the present invention shall fall within the protection scope of the present invention.

In descriptions of the present invention, it should be understood that the terms, such as "first" and "second" are used only for the purpose of description, and should not be understood as indicating or implying the relative importance or implicitly specifying the number of the indicated technical features. Thus, features defined by "first" and "second" may explicitly or implicitly include one or more of the features. In the descriptions of the present invention, unless otherwise explicitly specified, "a plurality of" means two or more than two.

In the present invention, unless otherwise explicitly stipulated and restricted, that a first feature is "on" or "under" a second feature may include that the first and second features are in direct contact, or may include that the first and second features are not in direct contact but in contact by using other features therebetween. Moreover, the first feature being "over", "above", and "on" the second feature includes that the first feature is directly above or obliquely above the second feature, or merely means that the first feature has a larger horizontal height than the second feature. That the first feature is "below", "under", and "underneath" the second feature includes that the first feature is right below the second feature and is not right below the second feature, or merely represents that a horizontal height of the first feature is lower than that of the second feature.

Many different implementations or examples are provided in the following disclosure to implement different structures of the present invention. To simplify the disclosure of the present invention, components and settings in particular examples are described below. Certainly, they are merely examples and are not intended to limit the present invention. In addition, in the present invention, reference numerals and/or reference letters may be repeated in different examples. The repetition is for the purposes of simplification and clearness, and a relationship. Moreover, the present invention provides examples of various particular processes and materials, but a person of ordinary skill in the art may be aware of application of another process and/or use of another material.

FIG. 1 is a schematic diagram of a structure of a computer desk when a desktop supplementary board is at a first position according to an embodiment of the present invention. The computer desk 100 includes a desktop 10, a turning device 11, and a desktop supplementary board 12. The desktop 10 is provided with an accommodating gap 101, and the desktop supplementary board 12 is connected to the desktop 10 using the turning device 11. A display 13 may be mounted on the turning device 11, and the turning device 11 may pass through the accommodating gap 101 to rotate relative to the desktop. During the rotation, the turning device 11 pulls the desktop supplementary board 12 to move, so that the desktop supplementary board 12, relative to the desktop 10, has a first position and a second position. In FIG. 1, the desktop supplementary board 12 is at the first position. In this case, the display 13 stands upright on the desktop 10, and the desktop supplementary board 12 is in the accommodating gap 101. It should be noted that "upright" in the specification is not limited to vertical or perpendicular to the desktop 10. In some embodiments, some height-adjustable silicone pad structures may be provided on the display 13 or first support rods 1111, so that an upright tilt angle of the display 13 may be adjusted according to requirements of a user.

The computer desk 100 further includes a desk body 14. The desk body 14 is located below the desktop 10 for supporting the desktop 10 and other structures above the desk body. Space surrounded by three sides is defined by the desk body 14, and the user sits on a side of the desk body 14 that is not surrounded, which is convenient to put legs of the user.

Preferably, when the desktop supplementary board 12 is at the first position, an upper surface of the desktop supplementary board 12 is flush with an upper surface of the desktop 10. Therefore, when the display 13 is displayed upright, the desktop 10 has no holes and can be used for normal office work. In addition, the display 13 is located on a side of the desktop supplementary board 12 away from the user. Therefore, a distance between the display 13 and the user is at least greater than a width of the desktop supplementary board 12, which can ensure that the user has a proper distance from the display 13 when the display 13 is displayed upright.

Figure 2:
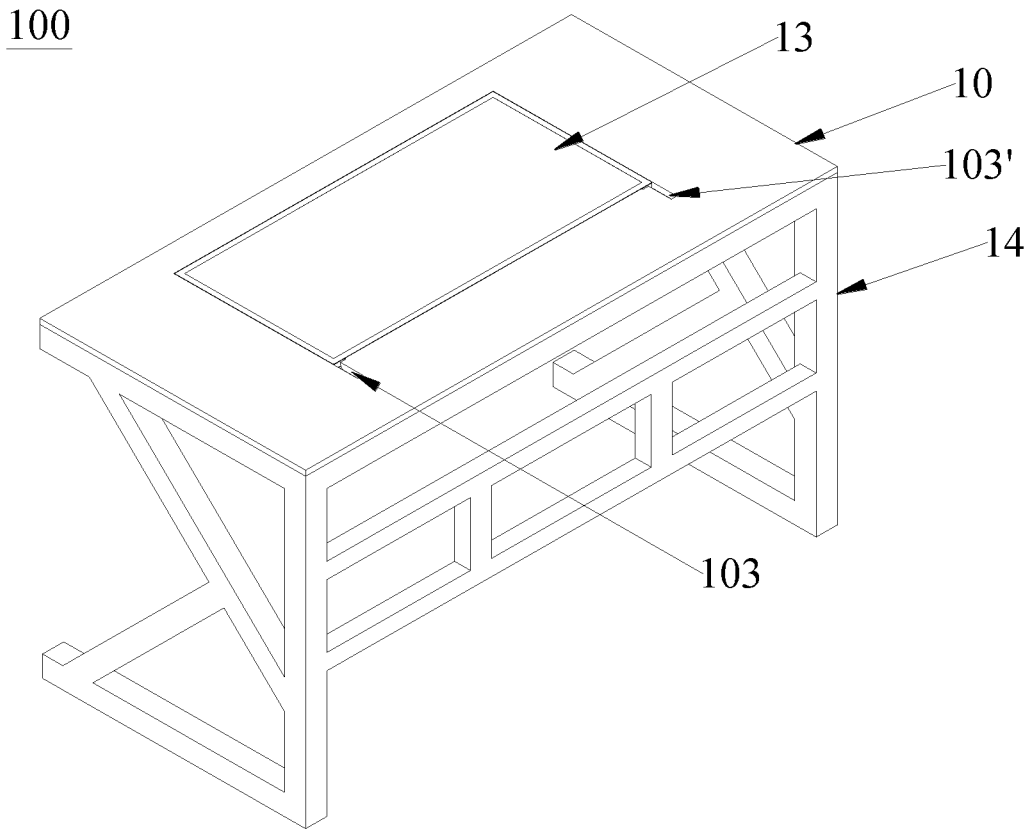
FIG. 2 is a schematic diagram of a structure of a computer desk when a desktop supplementary board is at a second position according to an embodiment of the present invention.

FIG. 2 is a schematic diagram of a structure of a computer desk when a desktop supplementary board is at a second position according to an embodiment of the present invention. In FIG. 2, the turning device 11 rotates for the desktop supplementary board 12 to reach the second position. In this case, the display 13 is in the accommodating gap 101, which can facilitate the user to perform touch operations on the flat display 13, for example, the user can directly create art works on the display 13, and can write, draw, do exercise, study, and the like on the display 13. The turning device 11 rotates to the back surface of the desktop 10, and the desktop supplementary board 12 is also pulled below the desktop 10 by the turning device 11. Therefore, the turning device 11 and the desktop supplementary board 12 are not shown in FIG. 2.

Figure 3:
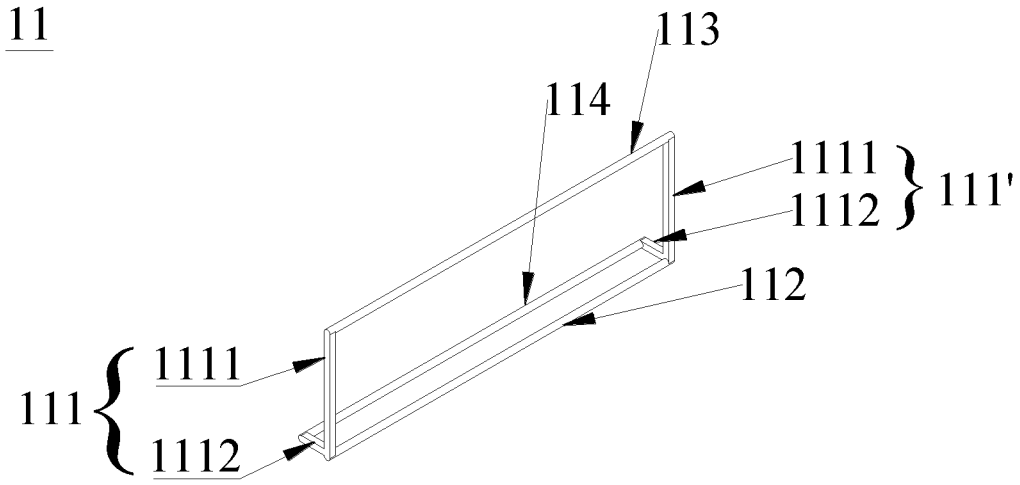
FIG. 3 is a schematic diagram of a structure of a turning device according to an embodiment of the present invention.

FIG. 3 is a schematic diagram of a structure of a turning device according to an embodiment of the present invention. The turning device 11 includes a first rotary shaft 112 mounted on the back surface of the desktop 10, a second rotary shaft 113 parallel to the first rotary shaft 112, a third rotary shaft 114 parallel to the first rotary shaft 112, a first connecting rod 111 separately connected to an end of the first rotary shaft 112, the second rotary shaft 113, and the third rotary shaft 114, and a second connecting rod 111' separately connected to an other end of the first rotary shaft 112, the second rotary shaft 113, and the third rotary shaft 114. The display 13 may be mounted on the second rotary shaft 113, and the third rotary shaft 114 is connected to the desktop supplementary board 12. For a specific structure, refer to the descriptions below.

Preferably, the first connecting rod 111 and the second connecting rod 111' are two parallel L-shaped connecting rods 111 (the first connecting rod 111 and the second connecting rod 111' are collectively referred to as the L-shaped connecting rods 111 below), and the first rotary shaft 112, the second rotary shaft 113, and the third rotary shaft 114 are vertically connected to the two L-shaped connecting rods 111. Specifically, each L-shaped connecting rod 111 includes a first support rod 1111 and a second support rod 1112 that are perpendicular to each other. The first rotary shaft 112 is separately connected to corners of the two L-shaped connecting rods 111, the second rotary shaft 113 is separately connected to end portions of the two first support rods 1111, and the third rotary shaft 114 is separately connected to end portions of the two second support rods 1112.

Figure 4:
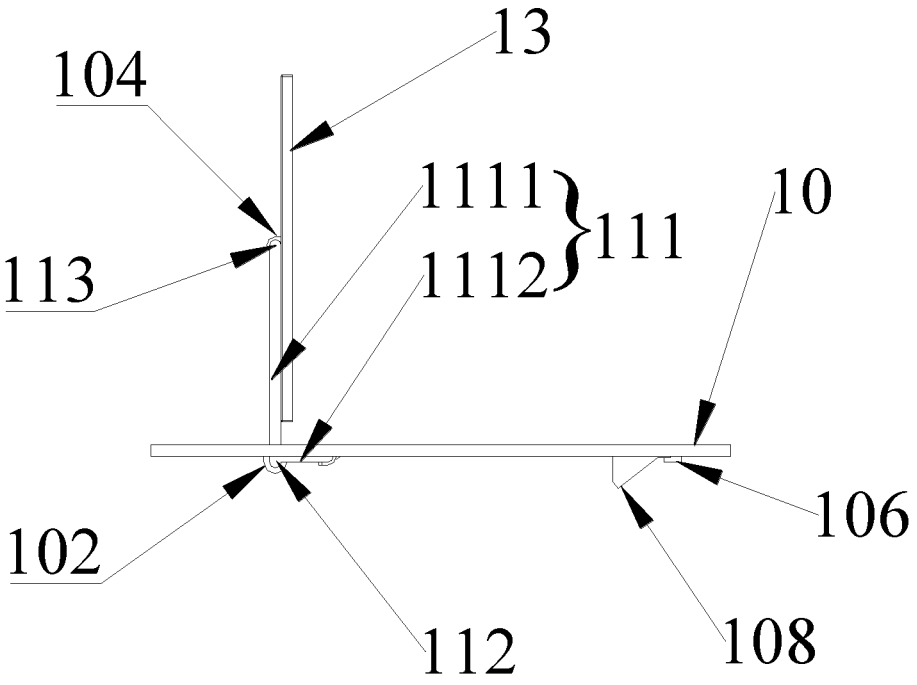
FIG. 4 is a side-view schematic diagram of a structure of a computer desk when a desktop supplementary board is at a first position according to an embodiment of the present invention.

FIG. 4 is a side-view schematic diagram of a structure of a computer desk when a desktop supplementary board is at a first position according to an embodiment of the present invention. It should be noted that, to display the structure of the desktop 10 more clearly, a structure of the desk body of the computer desk is hidden in FIG. 4. In the present embodiment, the desktop supplementary board 12 is at the first position, and the display 13 is displayed upright. The first support rod 1111 and the second rotary shaft 113 are located on a front surface of the desktop 10. The first rotary shaft 112, the third rotary shaft 114 (not shown in FIG. 4), and the second support rod 1112 are located on the back surface of the desktop 10. A structure on the back surface of the desktop 10 hardly occupies space where the legs are.

In the present embodiment, a first rotating ring 102 and a second rotating ring (only the first rotating ring 102 is shown in the figure) are mounted on the back surface of the desktop 10. Two ends of the first rotary shaft 112 are respectively connected to the first rotating ring 102 and the second rotating ring. When the first rotary shaft 112 rotates in the first rotating ring 102 and the second rotating ring, the turning device 11 rotates relative to the desktop 10. A motor drive may be installed on the first rotary shaft 112 manually or as required, for the turning device 11 to rotate around the first rotary shaft 112, that is, to rotate in the first rotating ring 102 and the second rotating ring. As shown in FIG. 1, because the turning device 11 may rotate relative to the desktop 10, in addition to the accommodating gap 101, the desktop 10 is also provided with a first opening slot 103 and a second opening slot (only the first opening slot 103 is shown in FIG. 1) that allow the first support rods 1111 to rotate through, so that the first support rods 1111 may rotate to the back surface of the desktop 10. When the desktop supplementary board 12 is at the first position, the first opening slot 103 and the second opening slot accommodate part of the first support rods 1111. In some embodiments, the turning device 11 may rotate relative to the desktop 10 by providing other rotating structures.

A third rotating ring 104 and a fourth rotating ring (only the third rotating ring 104 is shown in the figure) are sleeved on the second rotary shaft 113 of the turning device 11. The third rotating ring 104 and the fourth rotating ring are connected to the back surface of the display 13. When the second rotary shaft 113 rotates in the third rotating ring 104 and the fourth rotating ring, the display 13 may rotate relative to the second rotary shaft 113. It may be seen from FIG. 1 that there are a third rotating ring 104 and a fourth rotating ring 104'. A width of the display 13 is equal to a width of the turning device 11 (a distance between the two L-shaped connecting rods 111). The display 13 stands upright against the turning device 11, and a left side and a right side of the display 13 lean on the first support rods 1111. In some embodiments, the display 13 may be detachably connected to the second rotary shaft 113, and the display 13 may rotate relative to the second rotary shaft 113. In the present embodiment, a quantity of the rotating rings is not limited in the present embodiment, wherein the first rotating ring 102 and the second rotating ring are configured to connect the turning device 11 and the desktop 10, and the third rotating ring 104 and the fourth rotating ring 104' are configured to connect the display 13 and the turning device 11.

Figure 5:
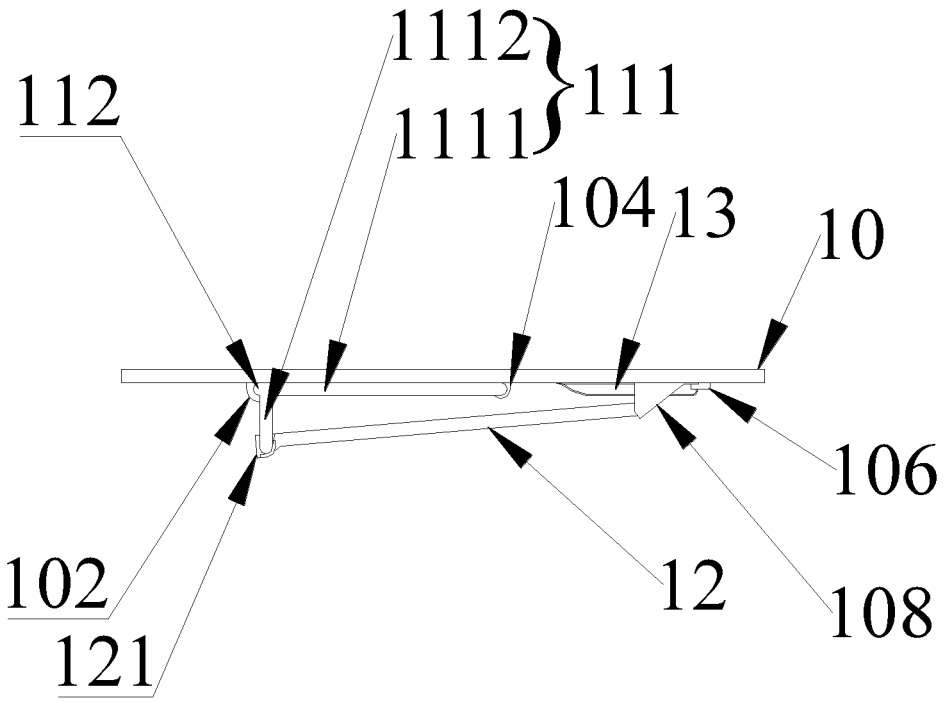
FIG. 5 is a side-view schematic diagram of a structure of a computer desk when a desktop supplementary board is at a second position according to an embodiment of the present invention.

FIG. 5 is a side-view schematic diagram of a structure of a computer desk when a desktop supplementary board is at a second position according to an embodiment of the present invention. Only other structures than the desk body are shown in FIG. 5. In the present embodiment, when the desktop supplementary board 12 is at the second position, the entire turning device 11 is located on the back surface of the desktop 10, that is, the L-shaped connecting rods 111, the first rotary shaft 112, the second rotary shaft 113 (not shown in FIG. 5), and the third rotary shaft 114 (not shown in FIG. 5) are all located on the back surface of the desktop 10. The desktop supplementary board 12 is located below the desktop 10. Therefore, only the desktop supplementary board 12 occupies the space where the legs are. A height of the occupied space is only equal to a length of the second support rod 1112, so that this structure occupies less space for the legs, and use comfort and applicability are relatively high. It may be understood that, in a process that the turning device 11 drives the desktop supplementary board 12 to rotate from the first position in FIG. 4 to the second position in FIG. 5, the first support rods 1111 and the second rotary shaft 113 rotate from the front surface of the desktop 10 to the back surface of the desktop 10. In the present embodiment, the display 13 is exactly in the accommodating gap 101, and the first support rods 1111 and the second rotary shaft 113 can exactly have a better effect of supporting the display 13.

In the present embodiment, the desktop supplementary board 12 has a first side connected to the third rotary shaft 114 of the turning device 11 and a second side opposite to the first side. The first side of the desktop supplementary board 12 has a rotating groove 121, and the third rotary shaft 114 is in the rotating groove 121. In a process of rotating the turning device 11 from the position in FIG. 4 to the position in FIG. 5, the second support rods 1112 perform a clockwise circular motion around the first rotary shaft 112, so that the desktop supplementary board 12 is driven by the third rotary shaft 114 to move from the accommodating gap 101 toward inclined lower of the desktop 10.

Figure 6:
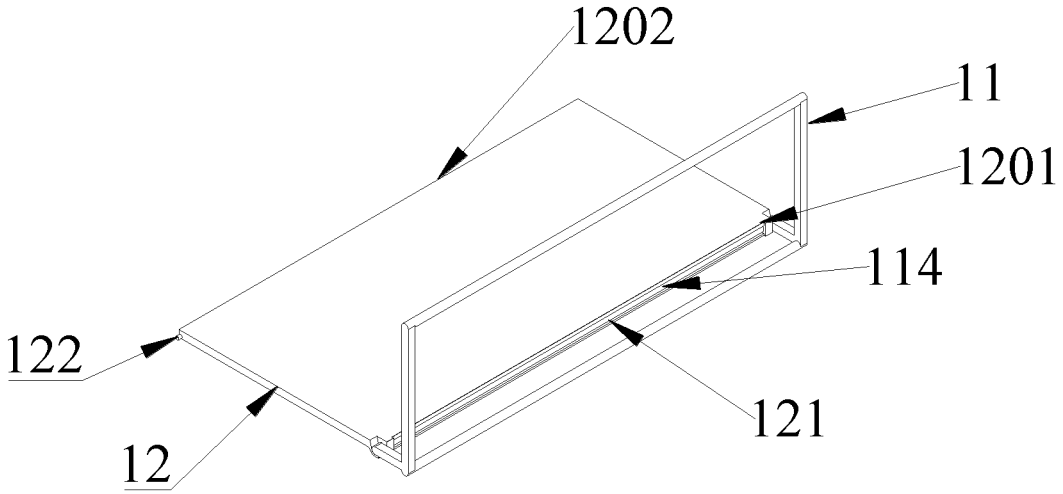
FIG. 6 is a schematic diagram of a structure of a turning device and a desktop supplementary board at a first position according to an embodiment of the present invention.

FIG. 6 is a schematic diagram of a structure of a turning device and a desktop supplementary board at a first position according to an embodiment of the present invention. A first side 1201 of the desktop supplementary board 12 has the rotating groove 121 for mounting the third rotary shaft 114. Two sides of a second side 1202 of the desktop supplementary board 12 have two rolling wheels 122, and only one rolling wheel 122 is shown in FIG. 6.

Figure 7:
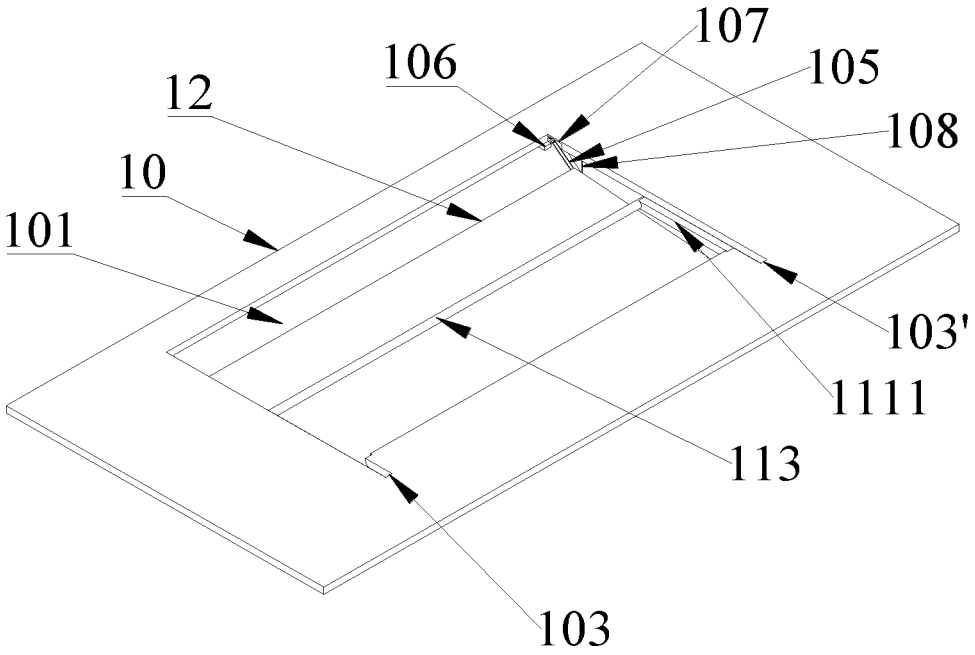
FIG. 7 is a schematic diagram of a structure of a desktop and a desktop supplementary board when the desktop supplementary board is at a second position according to an embodiment of the present invention.

FIG. 7 is a schematic diagram of a structure of a desktop and a desktop supplementary board when the desktop supplementary board is at a second position according to an embodiment of the present invention. To show a connection relationship between the desktop supplementary board 12 and the desktop 10, a structure of the display is hidden in FIG. 7. In the present embodiment, two sliding rails 105 (only one of which is shown in the figure) are mounted on the back surface of the desktop 10, and the two rolling wheels 122 on the desktop supplementary board 12 are respectively located in the two sliding rails 105, so that side edges of the desktop supplementary board 12 can slide along the sliding rails 105.

As shown in FIG. 7, a first opening slot 103 and a second opening slot 103' are in communication with the accommodating gap 101, and the first opening slot 103 and the second opening slot 103' are respectively located at two ends of the first rotary shaft 112.

Figure 8:
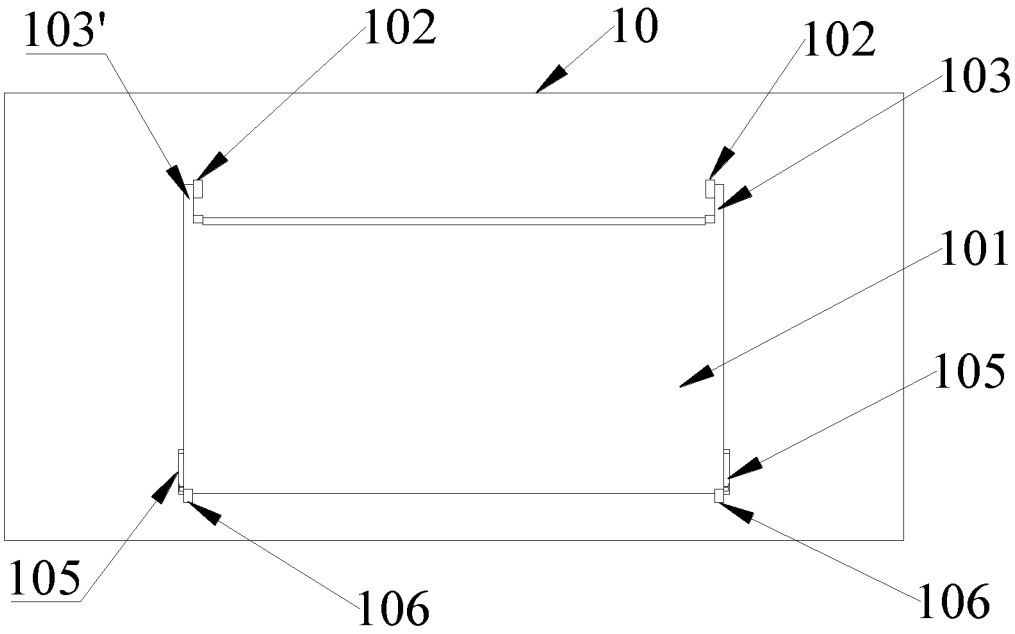
FIG. 8 is a schematic diagram of a structure of a back surface of a desktop according to an embodiment of the present invention.

FIG. 8 is a schematic diagram of a structure of a back surface of a desktop according to an embodiment of the present invention. Two sliding rails 105 are mounted on the back surface of the desktop 10, and the sliding rails 105 are adjacent to the accommodating gap 101. In the present embodiment, two support blocks 106 are further mounted on the back surface of the desktop 10. The support blocks 106 are located at an edge of the accommodating gap 101 close to the user and partially extend into the accommodating gap 101. As shown in FIG. 8, when the display is in the accommodating gap 101, the support blocks 106, the first support rods 1111 (not shown in FIG. 8), and the second rotary shaft 113 (not shown in FIG. 8) may simultaneously support the display upwards.

Figure 9:
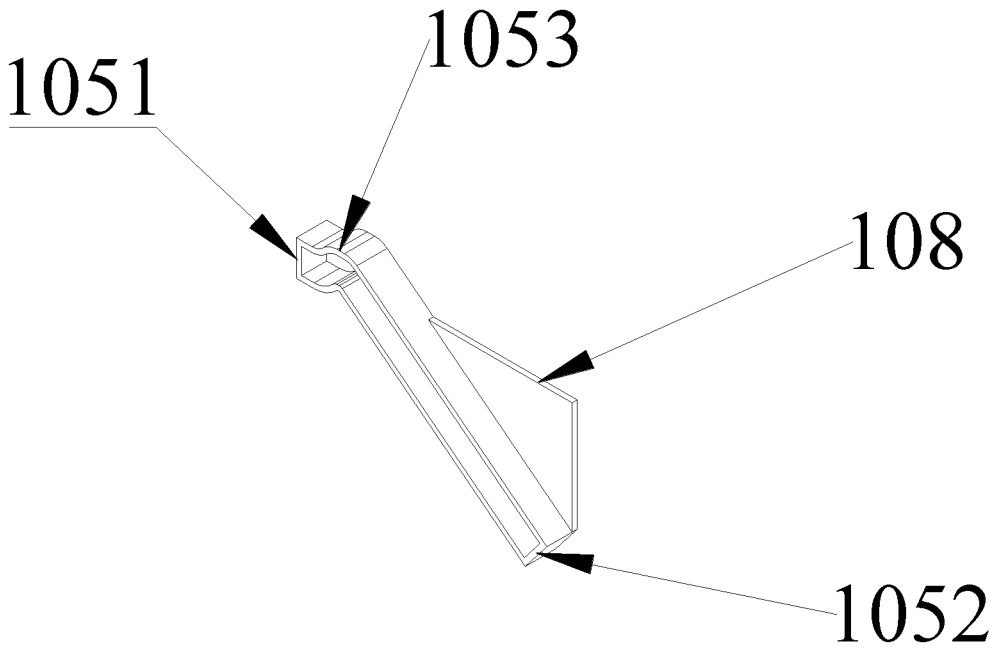
FIG. 9 is a schematic diagram of a structure of a sliding rail according to an embodiment of the present invention.

FIG. 9 is a schematic diagram of a structure of a sliding rail according to an embodiment of the present invention. The sliding rail 105 has a first end 1051 located at a corner of the accommodating gap 101 and a second end 1052 located obliquely below the first end. When the desktop supplementary board 12 is at the first position, the rolling wheel 122 is located at the first end 1051 of the sliding rail 105. When the desktop supplementary board 12 is at the second position, the rolling wheel 122 is located at the second end 1052 of the sliding rail 105. In the present embodiment, the sliding rail 105 has a third end 1053 near the first end 1051, and the third end 1053 is higher than the first end 1051. Therefore, a rising section from the first end 1051 to the third end 1053 and a descending section from the third end 1053 to the second end 1052 can be formed on the sliding rail 105. In the present embodiment, the sliding rail 105 is a groove with only one side opening. Therefore, when the desktop supplementary board 12 is in the accommodating gap 101, the rolling wheel 122 can be supported by the first end 1051. When the desktop supplementary board is located below the desktop 10, the rolling wheel 122 can be supported by the second end 1052.

During the movement of the desktop supplementary board 12 from the accommodating gap 101 to the bottom of the desktop 10, the rolling wheel 122 slides from the first end 1051 to the second end 1052 through the third end 1053. Due to a certain weight of the desktop supplementary board 12, during an ascending process of the rolling wheel 122 from the first end 1051 to the third end 1053, gravity of the desktop supplementary board 12 needs to be overcome, so that a certain force is required to rotate the turning device 11 to make the rolling wheel 122 slide upward from the first end 1051 to the third end 1053. Therefore, in a case that no force is applied, the turning device 11 is less likely to rotate forward, and the ascending section from the first end 1051 to the third end 1053 can prevent the turning device 11 and the display 13 from falling forward, thereby ensuring stability of upright of the display 13.

In the present embodiment, as shown in FIG. 7, a height of the first end 1051 of the sliding rail 105 is same as a height of the rolling wheel 122 when the desktop supplementary board 12 is in the accommodating gap 101, so that the rolling wheel 122 is exactly located at the first end 1051 of the sliding rail 105. Therefore, the back surface of the desktop 10 has a groove 107. The groove 107 is configured to accommodate the first end 1051 of the sliding rail 105, for the first end 1051 of the sliding rail 105 to be located in the groove 107, and the height of the first end 1051 is same as the height of the rolling wheel 122. That is, a thickness of the desktop 10 at a position where the first end 1051 of the sliding rail 105 is mounted is reduced.

In the present embodiment, a retaining wall 108 is further mounted on the desktop 10. The retaining wall 108 is a triangle and located at an outer side of the sliding rail 105. One side of the retaining wall is connected to the sliding rail 105 and the other is mounted on the back surface of the desktop 10. The retaining wall 108 can not only improve stability of mounting of the sliding rail 105, but also improve aesthetics and safety, and prevent the sliding rail 105 from scrapping the user.

Figure 10:
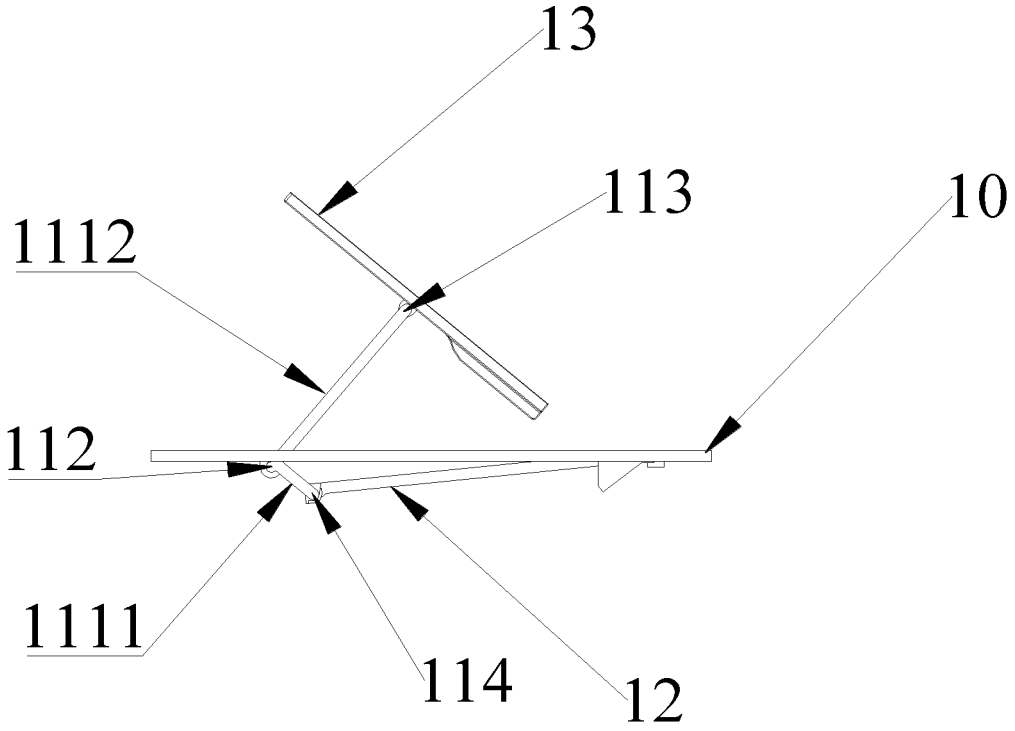
FIG. 10 is a side-view schematic diagram of a structure of a computer desk during rotation of a turning device according to an embodiment of the present invention.

FIG. 10 is a side-view schematic diagram of a structure of a computer desk during rotation of a turning device according to an embodiment of the present invention. With reference to FIG. 1, FIG. 2, FIG. 4, and FIG. 5, specific operations for converting the display 13 from an upright state to a flat state are as follows: When the desktop supplementary board 12 is at the first position, the display 13 stands upright. When the turning device 11 is driven to rotate around the first rotary shaft 112, the display 13 gradually follows the second rotary shaft 113 to lower and approach the desktop 10, while the display 13 rotates counterclockwise around the second rotary shaft 113. The third rotary shaft 114 pulls the desktop supplementary board 12 to move downward and backward, and drives another end of the desktop supplementary board 12 to break through a small ascending section to slide toward the descending section. The turning device 11 continues to rotate, and the desktop supplementary board 12 continues to move downward and backward until the display 13 is placed in the accommodating gap 101. The display 13 and the desktop 10 are coplanar. To keep stability, one end of the display 13 is supported by the turning device 11, the other end is supported by the support blocks 106 extending from the desktop 10, and the weight of the display 13 and the desktop supplementary board 12 can prevent reverse rotation of the display. For the display 13 to switch from the flat state to the upright state, reverse operations of the above operations may be performed.

A computer desk 100 provided in the embodiments of the present invention includes a desktop 10, a turning device 11, which may rotate relative to the desktop 10, and a desktop supplementary board 12 connected to the turning device 11. The desktop 10 is provided with an accommodating gap 101. The turning device 11 may be used to install a display 13. The turning device 11 drives the desktop supplementary board 12 to move during the rotation, so that the desktop supplementary board 12 has a first position and a second position. When the desktop supplementary board 12 is at the first position, the desktop supplementary board 12 is in the accommodating gap 101, and the display 13 stands upright on the desktop 10. When the desktop supplementary board 12 is at the second position, the display 13 is in the accommodating gap 101. Therefore, touch operations of the display 13 in an upright state and a flat state may be implemented. In addition, when the display 13 is in the upright state, the desktop supplementary board 12 is in the accommodating gap 101 of the desktop 10, for the desktop to be used for normal office work. When the display 13 is in the flat state, the desktop supplementary board 12 is located below the desktop 10 and does not occupy much space where the legs are.

The descriptions of the foregoing embodiments are merely used for helping understand the technical solutions of the present invention and the core idea thereof. A person of ordinary skill in the art should understand that, modifications may still be made to the technical solutions in the foregoing embodiments, or equivalent replacements may be made to some of the technical features; and such modifications or replacements will not cause the essence of corresponding technical solutions to depart from the scope of the technical solutions in the embodiments of the present invention.

What is claimed is:

1. A computer desk, comprising:

a desktop, wherein the desktop is provided with an accommodating gap; and a desktop supplementary board, wherein the desktop supplementary board is connected to the desktop using a turning device, and a display is mounted on the turning device; and the desktop supplementary board has, relative to the desktop, a first position and a second position, when the desktop supplementary board is at the first position, the desktop supplementary board is in the accommodating gap, and the display stands upright on the desktop, and when the desktop supplementary board is at the second position, the desktop supplementary board is located below the desktop, and the display is in the accommodating gap;

wherein the turning device comprises:

a first rotary shaft, wherein the first rotary shaft is mounted on a back surface of the desktop;

a second rotary shaft parallel to the first rotary shaft, wherein the second rotary shaft is provided with the display;

a third rotary shaft parallel to the first rotary shaft, wherein the third rotary shaft is connected to the desktop supplementary board;

a first connecting rod separately connected to one end of the first rotary shaft, the second rotary shaft, and the third rotary shaft; and a second connecting rod separately connected to an other end of the first rotary shaft, the second rotary shaft, and the third rotary shaft;

wherein the first connecting rod and the second connecting rod are two L-shaped connecting rods parallel to each other, each L-shaped connecting rod comprises a first support rod and a second support rod that are perpendicular to each other, two ends of the first rotary shaft are respectively connected to corners of the two L-shaped connecting rods, two ends of the second rotary shaft are respectively connected to end portions of the two first support rods, and two ends of the third rotary shaft are respectively connected to end portions of the two second support rods.

2. The computer desk as claimed in claim 1, wherein the back surface of the desktop is provided with a first rotating ring and a second rotating ring, the end of the first rotary shaft is connected to the first rotating ring, and the other end of the first rotary shaft is connected to the second rotating ring.

3. The computer desk as claimed in claim 2, wherein when the first rotary shaft rotates in the first rotating ring and the second rotating ring, the turning device rotates relative to the desktop.

4. The computer desk as claimed in claim 1, wherein the desktop is further provided with a first opening slot and a second opening slot that communicate with the accommodating gap, the first opening slot and the second opening slot being respectively located at the two ends of the first rotary shaft; and when the desktop supplementary board is at the first position, the first opening slot and the second opening slot accommodate part of the first support rod.

5. The computer desk as claimed in claim 1, wherein a third rotating ring and a fourth rotating ring are respectively sleeved at the two ends of the second rotary shaft of the turning device, and the third rotating ring and the fourth rotating ring are respectively connected to the display.

6. The computer desk as claimed in claim 1, wherein when the second rotary shaft rotates in the third rotating ring and the fourth rotating ring, the display rotates relative to the second rotary shaft.

7. The computer desk as claimed in claim 1, wherein the desktop supplementary board has a first side connected to the third rotary shaft and a second side opposite to the first side, the first side of the desktop supplementary board has a rotating groove, and the third rotary shaft is located in the rotating groove.

8. The computer desk as claimed in claim 7, wherein two sides of the second side of the desktop supplementary board have two rolling wheels, two sliding rails are further mounted on the back surface of the desktop, and the two rolling wheels are respectively located in the two sliding rails.

9. The computer desk as claimed in claim 8, wherein the sliding rail has a first end located at a corner of the accommodating gap and a second end located obliquely below the first end, when the desktop supplementary board is at the first position, the rolling wheel is located at the first end of the sliding rail, and when the desktop supplementary board is at the second position, the rolling wheel is located at the second end of the sliding rail.

10. The computer desk as claimed in claim 9, wherein the sliding rail has a third end near the first end, and the third end is higher than the first end.

11. The computer desk as claimed in claim 1, wherein when the desktop supplementary board is in the accommodating gap, and the display stands upright on the desktop, a distance between the display and a user is greater than a width of the desktop supplementary board.

12. The computer desk as claimed in claim 4, wherein when the desktop supplementary board is at the first position, the first rotary shaft, the third rotary shaft, and the second support rod are located on the back surface of the desktop, and when the desktop supplementary board is at the second position, the turning device is located on the back surface of the desktop.

13. The computer desk as claimed in claim 1, wherein a width of the display is equal to a distance between the two L-shaped connecting rods.

14. The computer desk as claimed in claim 1, wherein the back surface of the desktop is further provided with two support blocks, and each support block is located at an edge of the accommodating gap and partially extends into the accommodating gap.

15. The computer desk as claimed in claim 14, wherein when the display is in the accommodating gap, the support block, the first support rod, and the second rotary shaft are in contact with a back surface of the display.

16. The computer desk as claimed in claim 9, wherein the back surface of the desktop has a groove accommodating the first end of the sliding rail.

17. The computer desk as claimed in claim 8, further comprising a retaining wall located outside each of the sliding rails, wherein the retaining wall is connected to the back surface of the desktop.

18. The computer desk as claimed in claim 1, further comprising a desk body, wherein the desk body is located below the desktop.

* * * * *